United States Patent [19]

Mass et al.

[11] 4,362,427

[45] Dec. 7, 1982

[54] SEALING STRIP

[75] Inventors: Ronald H. Mass, Naperville; Daniel L. Maloney, Chicago, both of Ill.

[73] Assignee: Schlegel Corporation, Rochester, N.Y.

[21] Appl. No.: 154,712

[22] Filed: May 30, 1980

[51] Int. Cl.[3] ..... E01C 11/10

[52] U.S. Cl. ..... 404/64; 52/396; 52/573; 49/475; 49/486

[58] Field of Search ..... 404/64, 65, 68, 69, 404/47, 48; 14/16.5; 49/493, 441, 486, 488; 52/396, 403; 49/490, 492

[56] References Cited

U.S. PATENT DOCUMENTS

| | | | |
|---|---|---|---|
| 2,156,681 | 5/1939 | Dewhirst | 52/396 |
| 2,230,688 | 2/1941 | Irwing | 404/65 |
| 3,150,748 | 9/1964 | Liskey | 52/403 |
| 3,308,726 | 3/1967 | Dreher | 404/67 |
| 3,330,187 | 7/1967 | Kohler et al. | 404/65 |
| 4,043,693 | 8/1977 | Brown | 404/64 |
| 4,290,249 | 9/1981 | Mass | 404/65 |

FOREIGN PATENT DOCUMENTS

| | | | |
|---|---|---|---|
| 214473 | 4/1961 | Austria | 404/67 |
| 2357318 | 5/1974 | Fed. Rep. of Germany | 404/64 |
| 748436 | 5/1956 | United Kingdom | 52/396 |
| 1478963 | 7/1977 | United Kingdom | 404/68 |

*Primary Examiner*—Nile C. Byers, Jr.
*Attorney, Agent, or Firm*—Steele, Gould & Fried

[57] ABSTRACT

A resilient, deformable, adhesive-free sealing strip for expansion joints in concrete comprises an elongated central core with a reinforcing web embedded therein. First, second and third pairs of fins extend from opposite sides of the central core, the first pair being shorter than the second and third pairs, the first pair disposed at the top of the strip and the second and third pairs being disposed at spaced intervals down the elongated core. Each pair of fins has a combined width greater than the width of the joint to be sealed. Upon insertion of the strip, the second and third pairs of fins are substantially deformed in the direction opposite insertion, exerting pressure against the concrete void walls, and through the central core, against one another, firmly locking the strip in place. The first pair of fins are only moderately so deformed, sealing the open top of the joint.

In an alternative embodiment, the reinforcing web may be embedded in a collapsible, compartmented chevron shaped sealing strip, of the kind having side walls which are adhesively bonded to the walls of the expansion joint.

8 Claims, 6 Drawing Figures

SEALING STRIP

BACKGROUND OF THE INVENTION

1. Field of the Invention

This invention relates to the field of sealing strips for expansion joints in concrete paving, and the like, and in particular, to reinforced sealing strips which lock themselves in position with and without the need for adhesives.

2. Description of the Prior Art

A reinforced sealing strip for expansion joints is disclosed in British Pat. No. 1,478,963—Bernardo and McManus. The sealing strip comprises a first compressible portion and a second longitudinal edge portion. The compressible portion comprises two hollow ribs, which may be provided with rigid reinforcing inserts. The strip is said to be useful for preformed grooves or for direct insertion into wet concrete. In the latter instance, however, it appears that the top portion of the groove must be wider, and accordingly, the preferred use seems to be in wet concrete. By way of contrast, the sealing strips taught herein do not require a specially shaped groove.

Among commercially popular sealing strips are those described in U.S. Pat. No. 3,718,403—Kerschner and U.S. Pat. No. 3,762,826—Bowman, the principal embodiment of each being substantially identical. The sealing strips described therein have the outline of a flattened chevron, and have flat side walls for engaging the concrete over a substantial surface area. Internal ribs define collapsible compartments, the ribs maintaining pressure against the side walls. Each specifically calls for the use of an adhesive which facilitates insertion and locks the sealing strip in place. Other configurations of sealing strips may be seen in U.S. Pat. No. 3,521,528—Wangerow, U.S. Pat. No. 3,899,260—Kerschner and U.S. Pat. No. 4,043,693—Brown. One embodiment of this invention avoids all of the problems connected with the use of internally collapsible structures by use of an elongated central core and a plurality of pairs of fins extending therefrom. This embodiment also shows that it is unnecessary for sealing joints to have large contact areas with the concrete, and notwithstanding the absence of such large contact areas, that the use of adhesives is unnecessary as well. This is a radical departure even from the reinforced sealing strip of British Pat. No. 1,478,963 which also relies on collapsible compartments, or in one embodiment, on expandable, initially evacuated compartments.

In the presently preferred adhesive-free embodiment, the sealing strip is locked into place by the forces exerted by two pairs of projecting fins, which are substantially deformed in the direction opposite insertion. It has been found that the fins not only exert pressure on the concrete, but exert pressure against one another through the central core. As a result, the sealing strip is firmly and securely locked into place. The principal seal at the top of the joint is formed by a smaller pair of fins, which are only slightly deformed as compared to to the locking fins. In the event there is a failure of the upper sealing fins, which are directed to keeping out debris the locking fins provide progressive backups. Removal of the sealing strip necessitates reversal of the locking fins entirely, which is extremely difficult.

Finally, the unitary structure of this embodiment, that is without internal ribs and compartments, particularly lends itself to simplified extruding processes, as compared to sealing strips heretofore available.

The other embodiment of this invention avoids most of the problems associated with the use of compartmented sealing strips, such as those shown in U.S. Pat. No. 3,521,528—Wangerow, by providing a reinforcing web embedded in the central vertical member. The twisting and stretching to which such sealing strips are ordinarily subjected during insertion, which weakens the seal, is substantially eliminated.

SUMMARY OF THE INVENTION

It is an object of this invention to provide an improved sealing joint for expansion joints in concrete paving.

It is another object of this invention to provide a reinforced sealing strip, to facilitate insertion.

It is still another object of this invention to provide an adhesive-free sealing strip.

It is yet another object of this invention to provide a sealing strip having a unitary structure, that is without hollow compartments and internal reinforcing ribs, to facilitate production by extrusion.

It is yet a further object of this invention to provide a sealing strip having means for sealing the joint against entry of debris and means for locking the sealing strip in place, functioning independently of one another, but the locking means serving as backup sealing means against debris and moisture.

It is yet a further object of this invention to provide improved compartmented sealing strips.

These and other objects are accomplished by a resilient, deformable sealing strip, comprising, in the presently preferred embodiment: a resilient, deformable sealing strip for expansion joints in concrete paving and the like, comprising in cross-section: a vertically extending central core; a reinforcing web embedded in the central core; a first pair of fins extending outwardly and substantially perpendicularly from the top of the central core, having ends adapted to engage opposite void walls of the joint, the first pair of fins sealing the joint against entry of moisture and debris; and, second and third substantially identical pairs of fins extending outwardly and upwardly from the central core, vertically spaced from the first pair of fins, from the bottom of the central core and from one another, the second and third pairs of fins also having ends adapted to engage the void walls, but extending beyond the ends of the first pair of fins when uncompressed, the second and third pair of fins locking the sealing strip in place and providing secondary sealing against the entry of moisture and debris, inward and outward movements of the void walls causing the fins of each of the second and third pair of fins to rotate in opposite directions and to an equal extent, in turn causing distortions of the central core, the reinforcing web localizing the distortions on the central core, enabling the distortions to cancel one another out, whereby an equilibrium condition of localized opposing forces enables the sealing strip to remain locked in place.

The shorter sealing fins are substantially perpendicular to the central core, prior to deformation, and have a substantially uniform, rectangular cross-section and rounded tips. The longer, locking fins are swept back at an angle inclined toward the shorter pair of fins, and are larger at their base, narrowing in cross-section to flat tips. The reinforcing web preferably comprises a wire web, having a plurality of longitudinal members and a zig-zag member interwoven therewith.

In an alternative embodiment, the sealing strip has a chevron shaped cross-section, with a central vertical member, two side vertical members, and three pairs of oppositely directed fins connecting the vertical members. The central vertical member has a reinforcing web embedded therein.

BRIEF DESCRIPTION OF THE DRAWINGS

There are shown in the drawings forms which are presently preferred, it being understood, however, that this invention is not limited to the precise arrangements and instrumentalities shown.

DETAILED DESCRIPTION OF THE PREFERRED EMBODIMENTS

Figure 1:
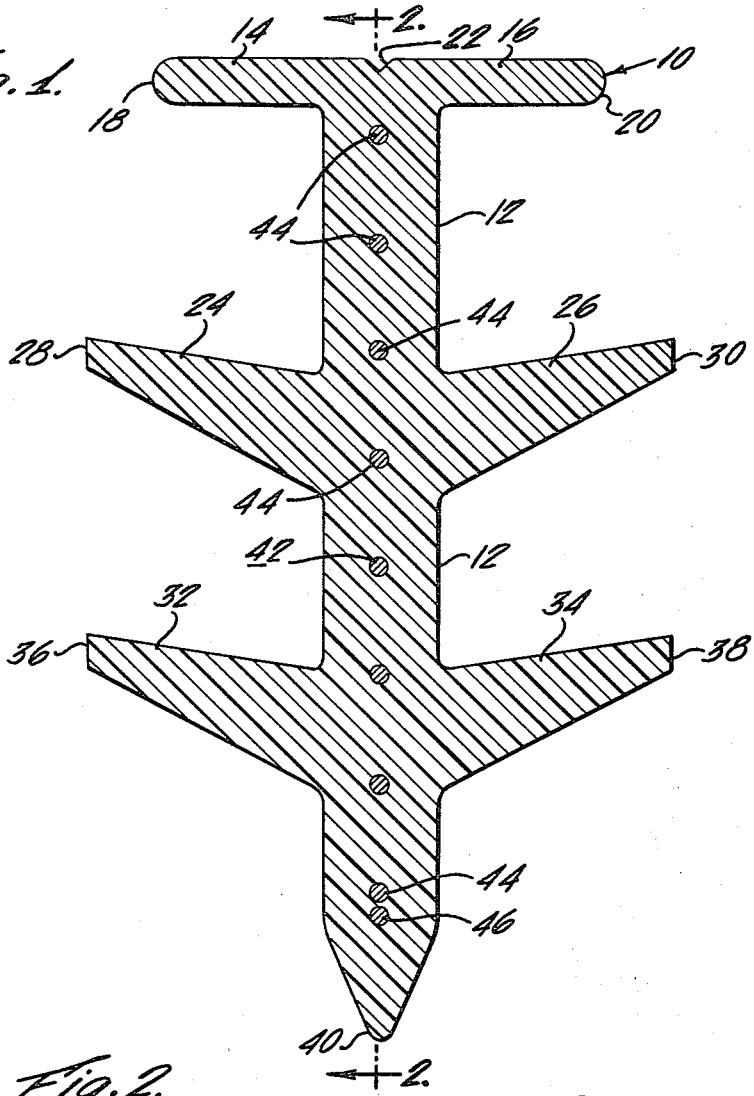
FIG. 1 is a section view of one embodiment of a sealing strip according to this invention.

A sealing strip according to one embodiment of this invention, in an undeformed condition prior to insertion in an expansion joint of a concrete structure, such as a highway, is illustrated in FIG. 1. Such sealing strips are normally provided in significant length, and are often cut to size on site. In describing this invention, the term width will refer to the direction across the open gap of the expansion joint or void.

The sealing strip 10 comprises an elongated central core 12 and a plurality of fins or members extending therefrom on opposite sides of the central core 12. A first pair of fins 14 and 16 extend substantially perpendicularly from the central core, at the top thereof, at least with respect to the orientation of FIG. 1. The first pair of fins 14 and 16 provide the primary seal against entry of debris across the top of the joint to be sealed. The thickness of fins 14 and 16 is substantially constant. The fins 14 and 16 terminate in rounded tips 18 and 20 respectively. A "V"-shaped notch 22 is disposed at the top of the central core 12 midway between the fins 14 and 16. The notch "closes" to some extent during insertion, and helps to prevent bulging of the sealing strip out of the joint. The notch also provides a guide for insertion tools.

A second pair of fins 24 and 26 is disposed approximately one-third of the way down the elongated central core. The fins 24 and 26 are longer than fins 14 and 16. The fins 24 and 26 are thickest at their base and narrow gradually toward flat tips 28 and 30 respectively. The fins 24 and 26 are swept back at an angle inclined toward the shorter pair of fins 14 and 16, opposite to the direction of insertion. The second pair of fins primarily serves as a locking and sealing means.

A third pair of fins 32 and 34, having flat tips 36 and 38 respectively, is disposed about two-thirds of the way down the elongated central core 12, and is substantially identical to the second pair of fins 24 and 26.

The bottom or insertion end of the strip is provided with a rounded point to facilitate insertion.

Figure 2:
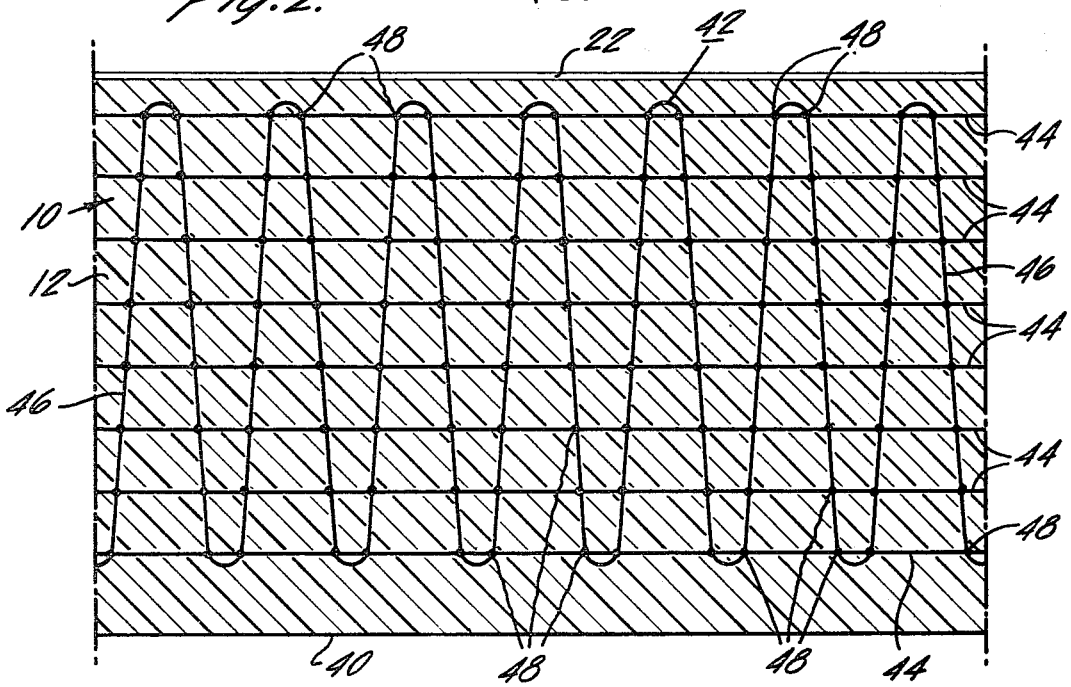
FIG. 2 is a section view of the sealing strip shown in FIG. 1, taken along the line 2—2.

The sealing strip 10, and the central core 12 in particular, has a reinforcing web 42 embedded therein, shown diagramatically in FIG. 2. The web 42 comprises a plurality of longitudinal members 44 and a zig-zag member 46 interwoven therewith at all cross-and-tie points 48. The web 42 is preferably formed from wire, but may be formed from other materials, such as fiber and monofilament as well. Further, the woven reinforcing members may be in other configurations.

The sealing strip, unlike strips heretofore available, has a unitary structure, that is no hollow compartments or internal ribs. Rather, the cross-section is solid, notwithstanding the embedded reinforcing web. Such a unitary structure particularly lends itself to production by relatively simple extrusion methods, as compared to the hollow, compartmentalized designs. The sealing strip may be constructed from any deformable, resilient material which can withstand the various petroleum products and other chemicals which typically find their way onto highway surfaces. Elastomeric rubber compounds and synthetic rubbers are an example of suitable materials.

In the embodiment shown in FIG. 1, typical, but by no means limiting dimensions are as follows. The overall height of the central core is 0.9 inches. The width of the central core is 0.1 inches. The combined width of the shorter fins 14 and 16 is 0.4 inches and the combined width of the longer fins, 24 and 26, and 32 and 34, is 0.52 inches. Where a deeper sealing strip is required, at least one further pair of longer, locking fins may be provided. The fins should be disposed at spaced intervals down the central core, as shown in FIG. 1, the spaces being substantially equal to the width of each fin. The vertical extent of the wire web, along the zig-zag course is 0.725 inches. In general, the dimensions will correspond to the joint former/crack inducer with which the sealing strip is used for preformed joint applications. One such joint former/crack inducer is Clearcrack, a trademark of Schlegel Corportion.

Figure 3:
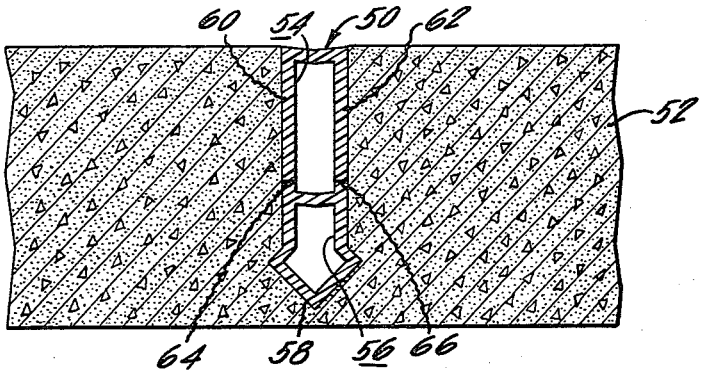
FIG. 3 is a section view of a joint former/crack inducer for use in wet concrete, with which the invention may be used.

A joint former/crack inducer 50 is shown inserted in wet concrete 52 in FIG. 3. The joint former/crack inducer has upper and lower sections 54 and 56, and is made from rigid PVC (polyvinyl chloride) material. The lower insertion section 56 has a pointed end 58 to facilitate insertion into the wet concrete. The upper section 54 comprises integral, tear-off top leaves 60 and 62. The break points are shown as dark blocks 64 and 66. After the concrete hardens, the tear-off top leaves are removed, leaving only the lower section 56, separating concrete blocks 68 and 70 by expansion joint or void 72.

The sealing strip 10 is inserted in the joint 72, between the void walls 68 and 70. As is apparent, the width of each pair of fins exceeds the width of the joint 72. As the strip is inserted, fins 32 and 34, and then fins 24 and 26 are substantially deformed in the direction opposite insertion. Each of the fins 24, 26, 32 and 34 exerts pressure against the walls of the void by reason of the resilient deformation of the elastomeric material. The fins not only press individually, but act on one another through the central core. It will be appreciated that the pressure from fins 26 and 34 pushes the core to the left, and the pressure from fins 24 and 32 pushes the core to the right. Further, for example, as fin 26 is deformed by a twisting, counter-clockwise movement, a section of the core designated 76 is pulled upwardly. However, this same section is pulled downwardly by a similar twisting movement of fin 34. A corresponding section 74 undergoes similar stress by the clockwise twisting movements of fins 24 and 32. The equilibrium conditions of the four balanced forces, shown by arrows 78, create a locking force sufficient to hold the sealing strip firmly in place without the need of large contact surface areas coated with cement. The smaller sealing fins 14 and 16 are only moderately deformed, as they are shorter than the locking fins. The "V"-shaped notch 22 tends to close, an ensures a bias against upward buckling of the sealing fins.

During insertion of the sealing strip, and under load, the reinforcing web 42 prevents unwanted compression and stretching (elongation) of the elongated central core. When such elongation occurs, the strip tends to "relax" afterward, often breaking the seal. Despite the rigidifying characteristic of the web, the resiliency and deformability of the sealing and locking fins is not impaired. Even after insertion, during the dynamic loading conditions of the expanding and contracting concrete void walls, the balance of forces, locking and sealing, is maintained as the fins move in accordance with movement of the blocks.

Figure 4:
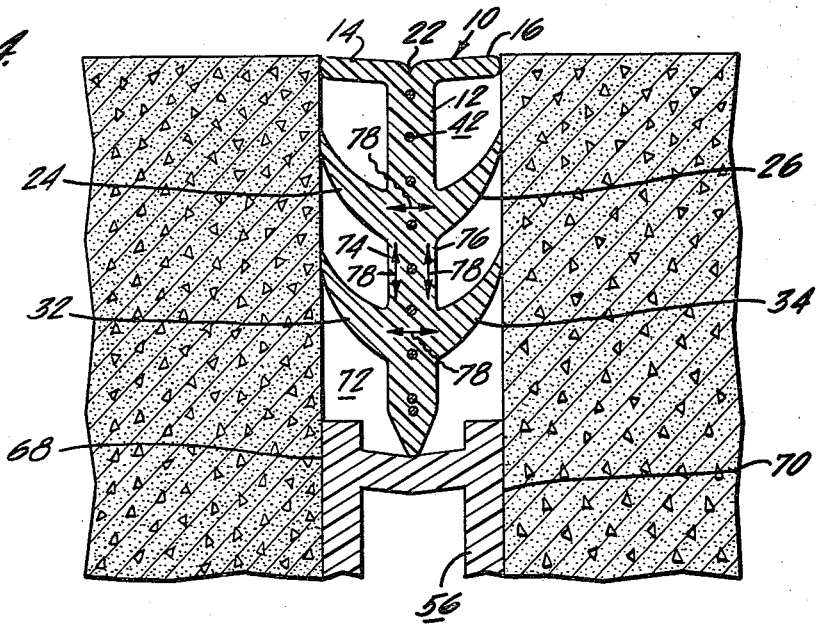
FIG. 4 is a section view of the sealing strip of FIG. 1, as deformed after insertion into the joint formed by the process illustrated in FIG. 3.

In the insertion technique illustrated in FIGS. 3 and 4, the dimensions of the sealing strip, as well as the depth of insertion, are determined according to the dimensions of the joint former/crack inducer. The sealing strip is not limited to this insertion technique and may be inserted into sawn joints as well.

Figure 5:
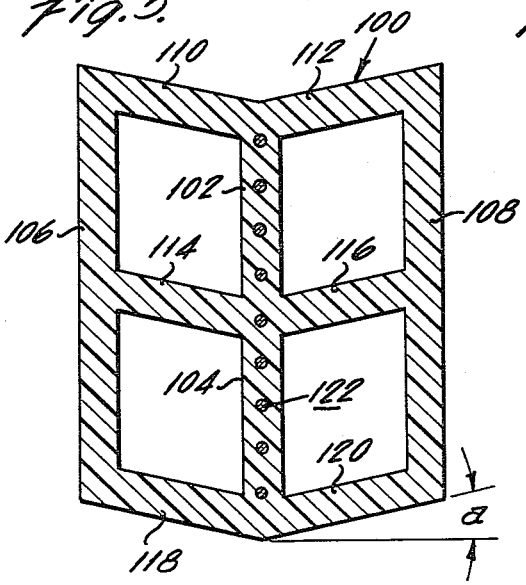
FIG. 5 is a section view of an alternative embodiment of a sealing strip according to this invention.
Figure 6:
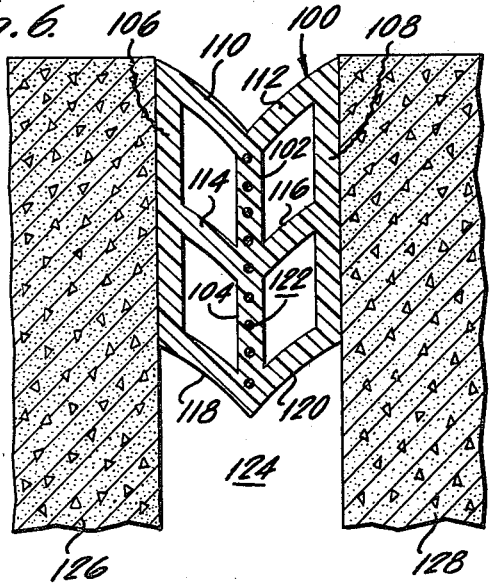
FIG. 6 is a section view of the sealing strip of FIG. 5, as deformed after insertion into an expansion joint void.

In another embodiment, shown in FIGS. 5 and 6, a sealing strip 100 is in the general form of a chevron. It comprises a central vertical (with respect to the orientation of FIG. 5) member having upper and lower portions 102 and 104 respectively. Two side vertical members 106 and 108 are connected to the central member by upper pair of fins or ribs 110 and 112, intermediate pair of internal fins or ribs 114 and 116, and lower pair of fins or ribs 118 and 120. In the presently preferred embodiment, the upper and lower fins or ribs define an angle "a" of approximately 11° and the horizontal. Other configurations and angles are also possible.

The entire central vertical member has a reinforcing web 122 embedded therein. The web is substantially similar to that described in connection with FIG. 2 hereof. The reinforcing web facilitates insertion, and equalizes distortion and deformation of the seal after insertion, stabilizing the seal immediately.

After insertion in an expansion joint or void 124, between concrete paving sections 126 and 128, the sealing strip is deformed as shown in FIG. 6. In unreinforced sealing strips of similar configuration, the sealing strip deforms unequally. Whereas the length of the upper and lower halves of the reinforced structure deform uniformly, equivalent halves of unreinforced strips show compression of the lower section and elongation of the upper section. Notwithstanding the use of adhesives in each, the unreinforced structure will be under unequal internal forces, and will tend to relax, that is to undeform, to relieve the pressures. If too much relaxation occurs, the seal will be broken. This invention virtually precludes such an undesirable result.

This invention may be embodied in other specific forms without departing from the spirit or essential attributes thereof, and accordingly, reference should be had to the appended claims, rather than to the foregoing Specification, as indicating the scope of the invention.

We claim:

1. A resilient deformable sealing strip for expansion joints in concrete, comprising in cross-section:

a vertically extending central core;

a reinforcing web embedded in the central core, the web having a plurality of interconnected longitudinal and vertical members which inhibit compression and elongation of the central core;

a first pair of fins extending outwardly and substantially perpendicularly from the top of the central core, having ends adapted to engage opposite void walls of the joint, the first pair of fins sealing the joint against entry of moisture and debris; and, second and third substantially identical pairs of fins extending outwardly and upwardly from the central core, vertically spaced from the first pair of fins, from the bottom of the central core and from one another, the second and third pairs of fins also having ends adapted to engage the void walls, but extending beyond the ends of the first pair of fins when uncompressed, the second and third pair of fins locking the sealing strip in place and providing secondary sealing against the entry of moisture and debris, inward and outward movements of the void walls causing the fins of each of the second and third pair of fins to rotate in opposite directions and to an equal extent, the rotation distorting the central core by compression and elongation thereof, the reinforcing web controlling the distortions on the central core by localizing the compression and elongation in a manner which produces, an equilibrium condition of localized opposing forces which lock the sealing strip in place.

2. The sealing strip of claim 1, wherein the reinforcing web is a wire web.

3. The sealing strip of claim 1, wherein the reinforcing web comprises a plurality of longitudinal members and a zig-zag member interwoven therewith.

4. The sealing strip of claim 1, wherein the central core, the reinforcing web and the fins are formed as an extrusion.

5. The sealing strip of claim 1, wherein the first pair of fins have a substantially uniform cross-section, and rounded ends.

6. The sealing strip of claim 5, wherein the central core has a "V"-shaped notch therein, disposed between the first pair of fins.

7. The sealing strip of claim 1, wherein the fins of the second and third pairs each have a cross-section which is largest at the juncture with the central core and smallest at the end, the wall engaging end being flat.

8. The sealing strip of claim 1, wherein the ends of the second and third pairs of fins are flat.

* * * * *